US007004223B2

(12) United States Patent
Brown et al.

(10) Patent No.: US 7,004,223 B2
(45) Date of Patent: Feb. 28, 2006

(54) METHOD AND APPARATUS FOR VACUUM MEASUREMENT DURING DIE CASTING

(75) Inventors: Zachary Brown, Kalamazoo, MI (US); Mark Musser, Osceola, IN (US); Joseph Bigelow, Vicksburg, MI (US)

(73) Assignee: SPX Corporation, Charlotte, NC (US)

( * ) Notice: Subject to any disclaimer, the term of this patent is extended or adjusted under 35 U.S.C. 154(b) by 33 days.

(21) Appl. No.: 10/739,580

(22) Filed: Dec. 19, 2003

(65) Prior Publication Data

US 2005/0133191 A1 Jun. 23, 2005

(51) Int. Cl.
*B22D 27/09* (2006.01)

(52) U.S. Cl. ..... 164/155.3; 164/155.4; 164/113

(58) Field of Classification Search ..... 164/113, 164/457, 155.3, 155.4
See application file for complete search history.

(56) References Cited

U.S. PATENT DOCUMENTS

| | | | | |
|---|---|---|---|---|
| 5,219,409 | A * | 6/1993 | Campbell et al. | 164/457 |
| RE34,559 | E | 3/1994 | Mickowski | 365/550 |
| 5,511,605 | A * | 4/1996 | Iwamoto | 164/457 |
| 5,566,743 | A * | 10/1996 | Guergov | 164/457 |
| 5,782,287 | A | 7/1998 | Iwamoto et al. | 164/155.3 |
| 5,979,536 | A | 11/1999 | Iwamoto et al. | 164/155.3 |
| 6,082,438 | A * | 7/2000 | Zielinski et al. | 164/457 |
| 6,425,433 | B1 * | 7/2002 | Hayes | 164/305 |

FOREIGN PATENT DOCUMENTS

| | | |
|---|---|---|
| DE | 101 40 657 | 11/2002 |
| JP | 09066351 | 3/1997 |
| JP | 2003285151 | 10/2003 |

* cited by examiner

*Primary Examiner*—Len Tran
(74) *Attorney, Agent, or Firm*—Baker & Hostetler LLP

(57) ABSTRACT

The method and apparatus of the present invention utilizes a computer and at least one pressure transducer for monitoring vacuum parameters in the operation of a die casting machine. A profile of the vacuum measurements are generated as a function of time and are graphically displayed on a shot monitor. The computer is optionally programmed with operator defined traces for comparison with acquired data profiles to segregate parts based on the comparison values.

20 Claims, 3 Drawing Sheets

METHOD AND APPARATUS FOR VACUUM MEASUREMENT DURING DIE CASTING

FIELD OF THE INVENTION

The present invention relates generally to die casting. More particularly, the present invention relates to an apparatus and method of measuring vacuum pressure during die casting.

BACKGROUND OF THE INVENTION

In die casting, molten metal is forced into the die from the hydraulic cylinder by a piston-type plunger or ram displaced over a linear stroke under controlled operating conditions. Research into die casting methodology has achieved a level of sophistication whereby the proper injection speeds, pressure (including vacuum pressure), and temperatures required for optimum operation for any given machine can be theoretically calculated. To satisfy the calculated conditions, however, the operations must be carried out within a relatively narrow range of settings for each of the critical process parameters. Variation in one or more of the process parameters can often affect the performance of the other parameters on the process and may alter the production rate, yield and/or quality of the product produced.

Alternatively, where process variation is inevitable or expected, by predicting part quality from the objective measurements, parts may then be segregated. Such a process is one feature in reducing the total cost for a production facility in producing a given product. In fact, substandard parts are preferably removed early in production before value added operations add more cost to a product that can not be sold. Such operations include, but are not limited to, drilling and tapping holes, or the machining of features.

One of the parameters that is subject to variation is the amount of gas present in the final product. Increasing concentrations of gases in a cast product directly correlate with increased porosity of the product which, in turn, can compromise part integrity. One approach to reducing the aforementioned variation has been to employ vacuum systems to assist in the removal of unwanted gases from a die cavity and shot sleeve prior to and during injection of molten metal. However, particularly where die cast parts are mass produced, inconsistent and/or inadequate vacuum systems can result in unacceptably wide variations in part quality. Such variety in part integrity then require additional measures for quality control which can be costly and time consuming.

Traditionally, to optimize the production output the process parameter settings are adjusted over a series of production runs until a product with desired characteristics and production yield is obtained. Since often times the events which affect the production cycle occur much too quickly for human observation it was necessary, heretofore, for operating personnel to make subjective judgments in adjusting process parameters in a production run frequently resulting in high scrap rates.

The trial and error technique commonly used heretofore also required more raw material than necessary in getting a given required production output. Moreover, because of the inability to precisely control and adjust the process parameters accurately, the design of the article produced typically had to be made with more material than necessary for functional or strength considerations simply to permit an acceptable yield.

Accordingly, a need exists for a diagnostic instrumentation system which can readily be applied to the process machinery to monitor and record objective measurements of machine performance during an actual production cycle. The objective measurements should represent machine operational data which can provide technical personnel with the means to make appropriate adjustments to not only maintain optimum process integrity but also predict part quality based on the measurements.

As the vacuum applied prior to and during casting of a product can be indicative of part quality, it would be desirable to provide a method and apparatus for measuring the vacuum in die casting machinery. It would also be desirable to apply vacuum consistently from one part to the next based on measured reading of the vacuum. It would be further desirable to provide a method and apparatus for segregating cast parts based on vacuum measurements taken before and during casting of the respective part.

SUMMARY OF THE INVENTION

The foregoing needs are met, to an extent, by the present invention, wherein in one aspect a method is provided for monitoring vacuum pressure in a die cavity of a die casting machine that includes a ram which traverses a stroke path, the method comprising: (a) measuring the position of the ram along the stroke path; (b) measuring pressure in the die cavity; (c) storing the position and pressure data in an electronic format; and (d) electrically generating an image comprising a graphical representation of pressure versus position of the ram along the stroke path based on the measured position and pressure. In some embodiments, the steps (a) and (b) are repeated and the storing step (c) comprises the step of storing indicia of measurements obtained by a repetition of the steps (b) and (c). The method may further comprise measuring the passage of time and also electrically generating a graphical representation of pressure versus time based on the measured time and the measured position.

In accordance with another embodiment of the present invention, a method is provided for monitoring vacuum pressure in a die cavity of a die casting machine which includes a ram traversing a stroke path during a ram cycle, the method comprising: (a) providing a time base; (b) measuring position of the ram for a first ram cycle; (c) measuring pressure in the die cavity for the first ram cycle; and (d) electrically generating a first graphical representation of pressure versus position of the ram for the first ram cycle based on the measured ram position and the measured pressure. The method may further comprise (e) electrically generating a second graphical representation of pressure versus time for the first ram cycle based on the measured ram pressure and the time base.

In accordance with yet another embodiment of the present invention, an apparatus is provided for monitoring the vacuum pressure in a die cavity of a die casting machine, the die casting machine including a ram which traverses a stroke path, the apparatus comprising: movement measuring means coupled to the ram for measuring the movement of the ram; pressure measuring means for measuring the pressure in the die cavity; means for storing indicia representing a master pressure profile for the die cavity; and electrical imaging means, coupled to the storing means, the movement measuring means and the pressure measuring means, for generating an image based on the measured movement and pressure. The apparatus may include images that comprise a first graphical representation of pressure versus position of the ram along the stroke path and/or a second graphical representation of pressure versus ram position along the stroke path based on the stored master pressure profile indicia.

In accordance with yet another embodiment of the present invention, a method is provided for sorting die cast parts produced from a die casting machine having a vacuum pressure in a die cavity and a ram traversing a stroke path during a ram cycle, the method comprising: (a) providing a time base; (b) measuring position of the ram for a first ram cycle; (c) measuring pressure in the die cavity for the first ram cycle; (d) electrically generating a first data set representation of pressure versus position of the ram for the first ram cycle based on the measured ram position and the measured pressure; (e) comparing the first data set generated with a database of master data, which master data provides maximal and minimal threshold values; and (f) sorting the die cast parts based, at least in part, on the results of the comparison. The method may further comprise electrically generating a second data set representation of pressure versus time based on the measured elapsed time and the measured pressure.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
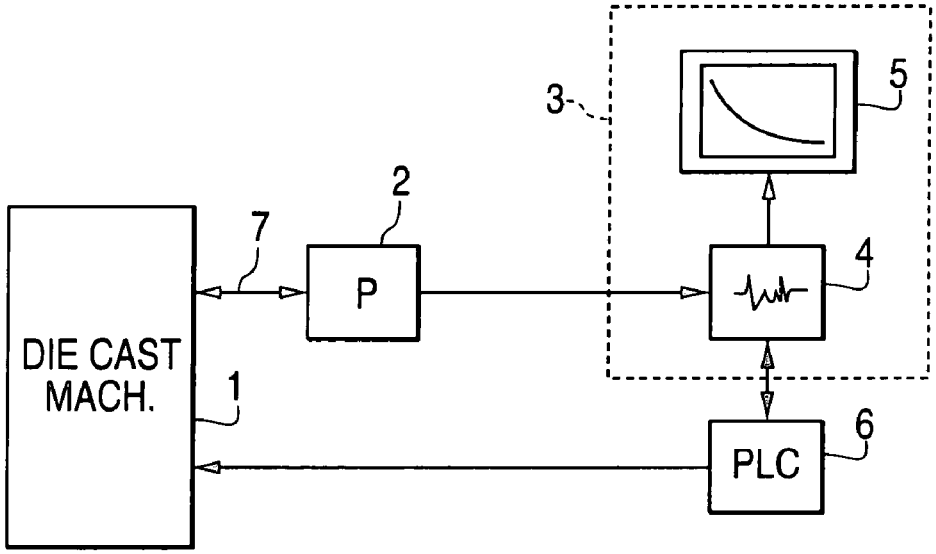
FIG. 1 is a block diagram of the data analysis and display system of the present invention

The invention will now be described with reference to the drawing figures, in which like reference numerals refer to like parts throughout. FIG. 1 diagrammatically illustrates one embodiment of a vacuum data analysis and display system of the present invention. In particular, the basic building blocks of the vacuum data analysis and display system of the present invention comprise a die casting machine 1, a vacuum pressure transducer 2, a shot monitor 3, including a processor 4 and a display 5, and a Programmable Logic Computer (PLC) 6.

The transducer 2 collects vacuum pressure data as a function time. Additionally, the time may be correlated to a function of a shot ram stroke position during a production cycle. The production cycle for a die casting or plastic molding operation is defined for purposes of the present invention as the stroke and corresponds to the motion of the injection shot ram which injects either metal into the die or plastic into a mold respectively. The stroke length represents the total displaced distance of the injection shot ram in the hydraulic cylinder for a single production cycle.

The transducers 2 of the present invention may be analog or digital transducers and may be conventionally available in the art. Preferably one transducer 2 is made available for each individual cavity in the die casting machine. In some embodiments, the transducer 2 may be a fully programmable transducer and used to monitor the vacuum pressure throughout the entire shot. Many vacuum transducers are known in the art and may be applicable in the instant invention. Preferably, in some embodiments, an Effector500, model no. PN2009 from IFM Electronic headquartered in Germany may be used.

Figure 2:
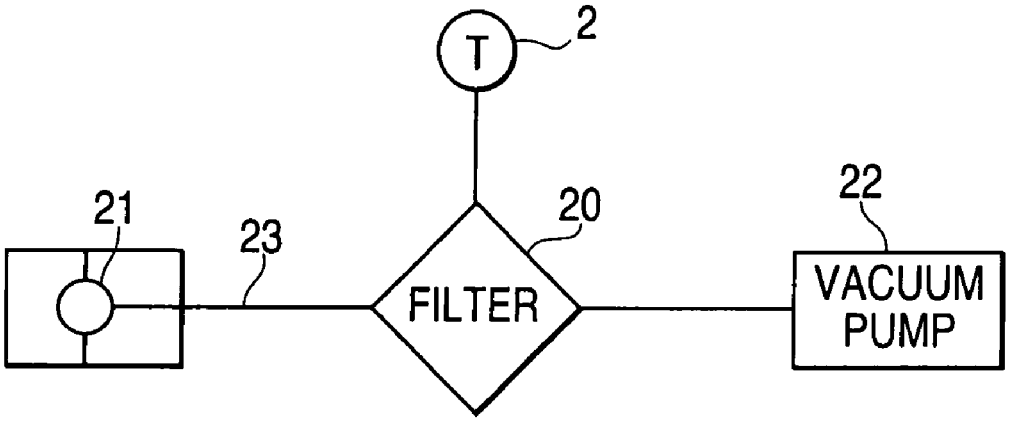
FIG. 2 is a block diagram of one arrangement of the present invention.

The transducers of the present invention may be placed at any point along the length of a vacuum line. Vacuum lines are generally coupled from within a die cavity to vacuum pump, which vacates the die cavity. Optionally, in many cases, a filter may be incorporated into a vacuum line 23 between a die cavity 21 and a vacuum pump 22 as shown in FIG. 2.

Referring back to FIG. 1, a pressure reading 7 may be signaled to the shot monitor 3. Preferably, in some embodiments the pressure reading 7 is signaled in real time or with negligible delay. The signal produced from the transducer is then received and interpreted by a machine shot monitoring software. A position and/or time based graphical image of the vacuum status can then be displayed on the shot-monitoring screen as a trace, as best shown in FIG. 3, and will be described in greater detail below.

A conventional processor 4 is connected to a conventional display 5 for displaying a vacuum trace representative of the data collected by the transducer 2 in accordance with programmed instructions. Any conventional software program format suitable for use with the processor 4 may be used in the preparation of a program. The program itself may be prepared by any skilled programmer from the flow diagrams. Preferably, readings from the transducer 2 can be presented in terms of vacuum pressure, vacuum pressure rise, and the amount of air displaced by the vacuum system for each individual shot cycle.

Figure 3:
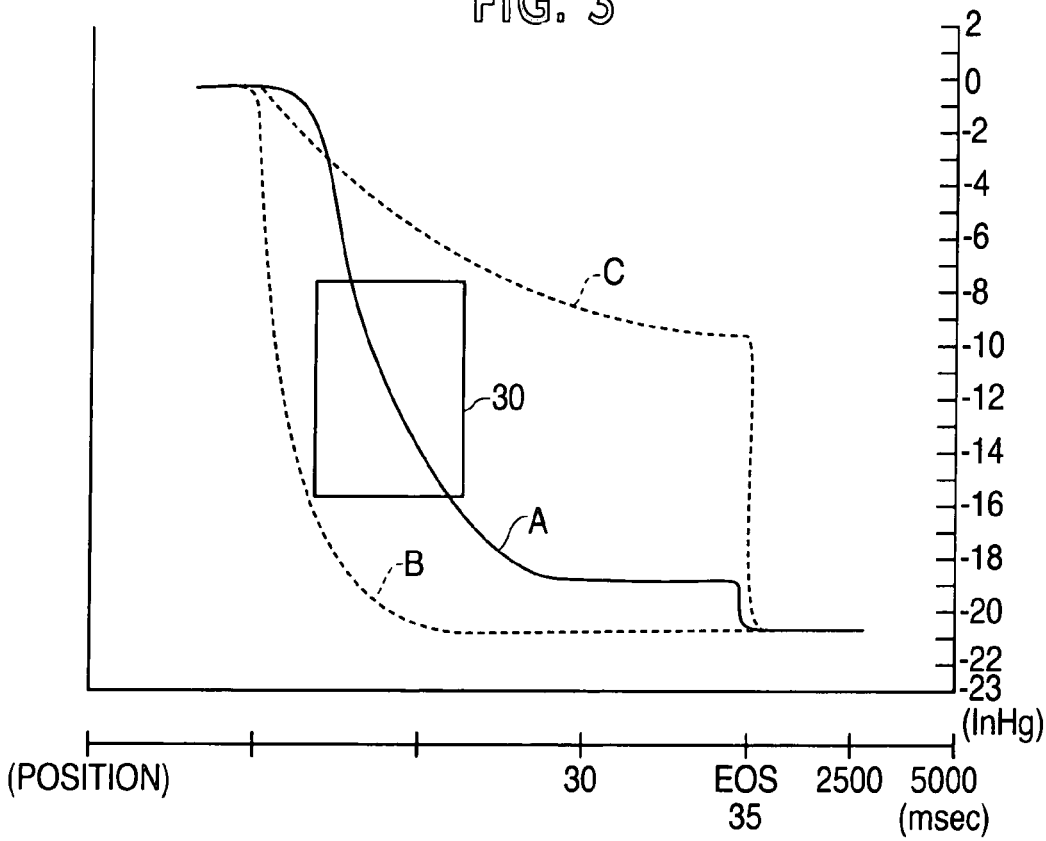
FIG. 3 is a representation of vacuum traces generated by the system of the present invention for a die casting machine.

An illustrated display of a typical profile representative of the vacuum pressure within a die cavity for a production cycle as a function of stroke position, i.e., the position of the reciprocating injection ram along the stroke length, is shown in FIG. 3. FIG. 3 depicts a trace A of vacuum pressure (Inches of Mercury (InHg) vs. both the position of the shot ram and time (msec). In the embodiment shown, the position of the ram is first displayed along the x-axis until the end of shot (EOS) after which, the vacuum trace A is plotted versus time. The position of the shot ram may be determined by any known detector and/or method available to one of ordinary skill in the art.

The information gathered and displayed on the shot monitor 3 may also be used to communicate information to the PLC 6 for automated decision making regarding part segregation. The automated part segregation feature may compare the trace values to user defined parameters for the purpose of deciding between a good part and a bad part. For example, a "master" profile may be used for comparison purposes with a "current" profile. A current profile is defined as a profile trace formed on the display 5 from data received by the processor 4 from the vacuum pressure transducer 2 in response to a current production cycle. Master profiles may be stored in computer memory and in fact any number of master profiles may be recorded and stored in the memory so as to constitute a library of master profiles. A master profile is stored at any directory in the memory can be identified by the operator through the use of a keyboard.

The shot monitoring software may provide the ability to superimpose master profiles over a current profile as shown in FIG. 2. The software may also be equipped with means to determine whether adequate vacuum has been achieved in a given cycle. For example, in one embodiment, a user defined box 30 may be incorporated into the processor 4 to define all acceptable traces of vacuum readings. The processor 4 can then determine whether a trace from a current cycle falls within or outside the box and then send the information to the PLC 6 so to segregate the part from that cycle accordingly. In addition an operator for the purpose of diagnosing part quality problems relating to the vacuum system can interpret this display.

Vacuum traces generated from the instant invention can also be used to determine where, if any, a restriction in a vacuum line may have occurred. For example, in some embodiments with an arrangement such as in FIG. 2, a vacuum trace B, with a steeper than normal (trace A) profile, can be indicative of a restriction in the vacuum line between the die cavity and the location where the vacuum transducer makes its reading in the filter 20. Alternatively, a flatter slop than normal can be indicative of a restriction beyond the filter 20.

The shot monitor 3 may be of any commercially available type which can generate a cursor. The position of a cursor is controlled by software and is adjustable over the stroke length and provides specific vacuum pressure information corresponding to its location. The display thereby permits the observer to readily observe vacuum pressure values at any time during a die cast cycle.

In this arrangement a non-technically trained person could distinguish between a master trace identifying a production run classified as acceptable or good and the current production run representing the current profile. It also becomes readily apparent to the operator where and to what extent adjustment may be necessary to conform subsequent production runs to the master trace. This is primarily attributable to the fact that the trace is a function of position and time.

The keyboard additionally provides for the numeric entry of upper and lower limits for each important parameter so as to define the acceptable range of such parameter for proper operation of the machine. In addition, the keyboard may be used to enter data corresponding to a machine number, ram plunger diameter and production cycle job number which collectively are used for the file identification for each master trace stored in memory.

The system may optional further include mass airflow sensors on the main vacuum lines to determine the amount of displaced air. If equipped with these sensors, the amount of displaced air will also be displayed on the monitoring display 6 and parameters established for part segregation.

Although the foregoing invention has been described specifically in connection with a die casting machine the invention is equally applicable for use with other machine types including, but not limited to, extrusion presses, low pressure die casting machines, permanent hold casting machines, forging presses, powder metal presses and trim presses. In addition, it should be understood that the present invention is not limited to graphic display and embraces numerical analysis and tabular display. It should further be understood that although vacuum process parameters may be displayed the invention is not limited to the display of only vacuum parameters. A plurality of profiles of any parameter including velocity, position, pressure, temperature, etc. may be displayed. In addition, the profiles may be analyzed and reduced to discreet results for display which results may be compared against preprogrammed constants stored in the processor such as low limits and alarm conditions.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method for monitoring vacuum pressure in a die cavity of a die casting machine, the die casting machine including a ram which traverses a stroke path, the method comprising:

(a) measuring the position of the ram along the stroke path;

(b) measuring pressure in the die cavity;

(c) storing the position and pressure data in an electronic format;

(d) electrically generating an image comprising a graphical representation of pressure versus position of the ram along the stroke path based on the measured position and pressure;

(e) comparing the first data set generated with a database of master pressure profile, the master pressure profile provides maximal and minimal threshold values; and (f) sorting the die cast parts based, at least in part, on the results of the comparison.

2. The method as in claim 1, wherein the steps (a) and (b) are repeated and the storing step (c) comprises the step of storing indicia of measurements obtained by a repetition of the steps (a) and (b).

3. The method as in claim 1, wherein the method further comprises measuring the passage of time and also electrically generating a graphical representation of pressure versus time based on the measured time and the measured pressure.

4. A method for monitoring vacuum pressure in a die cavity of a die casting machine, the die casting machine including a ram traversing a stroke path during a ram cycle, the method comprising:

(a) providing a time base;

(b) measuring position of the ram for a first ram cycle;

(c) measuring pressure in the die cavity for the first ram cycle;

(d) electrically generating a first graphical representation of pressure versus position of the ram for the first ram cycle based on the measured ram position and the measured pressure;

(e) comparing the first data set generated with a database of master pressure profile, the master pressure profile provides maximal and minimal threshold values; and (f) sorting the die cast parts based, at least in part, on the results of the comparison.

5. The method as in claim 4, wherein the method further comprises (e) electrically generating a second graphical representation of pressure versus time for the first ram cycle based on the measured ram pressure and the time base and wherein the pressure as a function of position is represented along a first axis graduated in position increments.

6. The method as in claim 4, wherein the step (d) includes the step of representing the pressure as a function of position along a first axis graduated in position increments.

7. The method as in claim 5, wherein the step (e) includes the step of representing the pressure as a function of time along a second axis, the second axis being graduated in time increments, the first and second axes being simultaneously viewable.

8. The method as in claim 4, wherein:

the stroke path has an end;

the method further includes determining when the ram reaches the end of the stroke path; and the step (d) comprises representing the pressure versus position of the moving ram when the ram reaches the end of the stroke path.

9. The method as in claim 5, wherein:

the stroke path has an end;

the method further includes determining when the ram reaches the end of the stroke path; and the step (e) further comprises representing the pressure versus time after the ram has reached the end of the stroke path.

10. The method as in claim 5, further comprising step (g) facilitating substantially simultaneous viewing of the first and second graphical representations.

11. The method as in claim 4, further comprising storing the position and pressure data in an electronic format.

12. An apparatus for monitoring the vacuum pressure in a die cavity of a die casting machine, the die casting machine including a ram which traverses a stroke path, the apparatus comprising:

movement measuring means coupled to the ram for measuring the movement of the ram;

pressure measuring means for measuring the pressure in the die cavity;

means for storing indicia representing a master pressure profile for the die cavity; and electrical imaging means, coupled to the storing means, the movement measuring means and the pressure measuring means, for generating an image based on the measured movement and pressure; and a part segregating means to segregate parts not conforming to the master pressure profile.

13. The apparatus as in claim 12, further comprising time measuring means for measuring the passage of time during the movement of the ram.

14. The apparatus as in claim 13, wherein the image comprises a first graphical representation of pressure versus position of the ram along the stroke path.

15. The apparatus as in claim 14, wherein the image comprises a second graphical representation of pressure versus ram position along the stroke path based on the stored master pressure profile.

16. The apparatus as in claim 15, wherein the first and second graphical representations are at least partially superimposed.

17. A method for sorting die cast parts produced from a die casting machine having a vacuum pressure in a die cavity and a ram traversing a stroke path during a ram cycle, the method comprising:

(a) providing a time base;

(b) measuring position of the ram for a first ram cycle;

(c) measuring pressure in the die cavity for the first ram cycle;

(d) electrically generating a first data set representation of pressure versus position of the ram for the first ram cycle based on the measured ram position and the measured pressure;

(e) comparing the first data set generated with a database of master pressure profile, the master pressure profile provides maximal and minimal threshold values; and (f) sorting the die cast parts based, at least in part, on the results of the comparison.

18. The method as in claim 17, further comprising electrically generating a second data set representation of pressure versus time based on the measured elapsed time and the measured pressure and comparing the second data set to the master pressure profile.

19. The method as in claim 17 further comprising storing a master pressure profile for the vacuum pressure.

20. An apparatus for monitoring the vacuum pressure in a die cavity of a die casting machine, the die casting machine including a shot ram which traverses a stroke path, the apparatus comprising:

a detector coupled to the shot ram that measures movement of the shot ram;

a transducer that measures the pressure in the die cavity;

a processor having a memory for storing a master pressure profile for the die cavity, the movement and pressure data; and a display, in communication with the processor, the detector and the transducer, that generates an image based on the measured movement and pressure wherein the image comprises a first graphical representation of pressure versus position of the shot ram along the stroke path, wherein the image comprises a second graphical representation of pressure versus ram position along the stroke path based on the master pressure profile, and wherein the first and second graphical representations are at least partially superimposed.

* * * * *

UNITED STATES PATENT AND TRADEMARK OFFICE

CERTIFICATE OF CORRECTION

PATENT NO. : 7,004,223 B2
APPLICATION NO. : 10/739580
DATED : February 28, 2006
INVENTOR(S) : Zachary Brown et al.

It is certified that error appears in the above-identified patent and that said Letters Patent is hereby corrected as shown below:

TITLE PAGE

Item (56), References Cited

Please insert the article "IFM Electronic, Efector500 Pressure Sensors PN2009"--;

Column 6

Line 32, please replace "measuring the" with --measuring a--;

Line 34, please insert --a-- after "measuring";

Line 35, please replace "storing the" with --storing a--;

Line 38, please replace "representation of pressure versus position" with --representation of the pressure versus the position--;

Lines 41-43, please replace "comparing the first data set generated with a database of master pressure profile, the master pressure profile provides maximal and minimal threshold values; and" with --comparing the pressure and position data with a master pressure profile database, the master pressure profile database provides maximal and minimal threshold values; and--;

Line 44, please replace "sorting the die cast parts" with --sorting a die cast part--;

Line 51, please replace "measuring the" with --measuring a--;

Lines 52-53, please replace "representation of pressure versus time" with --representation of pressure versus the time--;

Line 60, please insert --a-- after "measuring";

Line 61, please insert --a-- after "measuring";

Line 62, please insert --and-- after "cycle;";

Line 64, please replace "of pressure versus position" with --of the pressure versus the position--;

Column 7

Lines 1-3, please replace "comparing the first data set generated with a database of master pressure profile, the master pressure profile provides maximal and minimal threshold values; and" with --comparing the pressure and position with a master pressure profile database, the master pressure profile database provides maximal and minimal threshold values; and--;

Line 4, please replace "sorting the die cast parts" with --sorting a die cast part--;

Line 7, please replace "comprises (e)" with --comprises (g)--;

UNITED STATES PATENT AND TRADEMARK OFFICE

CERTIFICATE OF CORRECTION

PATENT NO. : 7,004,223 B2
APPLICATION NO. : 10/739580
DATED : February 28, 2006
INVENTOR(S) : Zachary Brown et al.

It is certified that error appears in the above-identified patent and that said Letters Patent is hereby corrected as shown below:

Line 8, please replace "representation of pressure versus time" with --representation of the pressure versus the time--;
Line 12, please replace "includes" with --comprises--;
Line 13, please replace "function of position" with --function of the position--;
Line 15, please replace "wherein the step (e) includes" with --wherein the step (g) comprises--;
Line 29, please replace "includes" with --comprises--;
Line 31, please replace "the step (e)" with --the step (g)--;
Line 34, please replace "comprising step (g)" with --comprising step (h)--;
Line 48, please delete "and";
Line 53, please replace "a part segregating means to segregate parts" with --a part sorting means to sort parts--;

Column 8

Line 16, please insert --a-- after "measuring";
Line 17, please insert --a-- after "measuring";
Line 19, please insert --the-- after "of";
Line 20, please insert --the-- after "versus";
Lines 23-25, please replace "comparing the first data set generated with a database of master pressure profile, the master pressure profile provides maximal and minimal threshold values; and" with --comparing the pressure and position with a master pressure profile database, the master pressure profile database provides maximal and minimal threshold values; and--;
Line 26, please replace "sorting the die cast parts" with --sorting a die cast part--;
Line 32, please insert --database-- after "profile";
Line 34, please insert --database-- after "profile";
Line 43, please insert --database-- after "profile";
Line 44, please delete "and";
Line 47, please insert --the-- after "and";
Line 48, please insert --the-- after "of";
Line 49, please insert --the-- after "versus";
Line 51, please insert --the-- after "of";

UNITED STATES PATENT AND TRADEMARK OFFICE

CERTIFICATE OF CORRECTION

PATENT NO. : 7,004,223 B2
APPLICATION NO. : 10/739580
DATED : February 28, 2006
INVENTOR(S) : Zachary Brown et al.

It is certified that error appears in the above-identified patent and that said Letters Patent is hereby corrected as shown below:

Line 53, please insert --database-- after "profile";

Line 54, please insert --; and a sorter that sorts a die cast part by comparing the pressure and the position with the master pressure profile database-- after "superimposed".

Signed and Sealed this

Twenty-ninth Day of August, 2006

JON W. DUDAS
*Director of the United States Patent and Trademark Office*